United States Patent [19]

Lienhard

[11] 4,156,996

[45] * Jun. 5, 1979

[54] SCAFFOLDING FOR WORKING ON CONTOURED SURFACES

[75] Inventor: Robert W. Lienhard, Pittsburgh, Pa.

[73] Assignee: Swiss Fabricating, Inc., Pittsburgh, Pa.

[ * ] Notice: The portion of the term of this patent subsequent to Nov. 15, 1994, has been disclaimed.

[21] Appl. No.: 850,715

[22] Filed: Nov. 11, 1977

Related U.S. Application Data

[63] Continuation-in-part of Ser. No. 659,991, Feb. 23, 1978, Pat. No. 4,057,943.

[51] Int. Cl.[2] ..... E04G 3/02; E04B 11/04

[52] U.S. Cl. ..... 52/126; 52/645; 182/178; 182/179

[58] Field of Search ..... 182/178, 179; 52/646, 52/648, 651, 645, 637, 638, 126; 220/10, 83, 9 LG

[56] References Cited

U.S. PATENT DOCUMENTS

| | | | |
|---|---|---|---|
| 2,185,948 | 1/1940 | Pimm | 182/178 |
| 2,237,572 | 4/1941 | Manion | 182/178 |
| 2,555,782 | 6/1951 | Brownstein | 182/178 |
| 2,882,100 | 4/1959 | Bank | 182/178 |
| 2,911,125 | 11/1959 | Dosker | 220/83 |
| 3,679,026 | 7/1972 | Hansen et al. | 182/128 |
| 3,800,970 | 4/1974 | Jackson | 220/10 |
| 3,948,412 | 4/1976 | Bennett | 52/249 |
| 4,057,943 | 11/1977 | Lienhard | 52/645 |

FOREIGN PATENT DOCUMENTS

| | | | |
|---|---|---|---|
| 800150 | 9/1950 | Fed. Rep. of Germany | 182/128 |
| 1577362 | 8/1969 | France | 52/126 |
| 447572 | 3/1968 | Switzerland | 182/179 |
| 13175 of | 1908 | United Kingdom | 5/300 |
| 863855 | 3/1961 | United Kingdom | 182/179 |

*Primary Examiner*—James L. Ridgill, Jr.
*Attorney, Agent, or Firm*—Robert D. Yeager

[57] ABSTRACT

Scaffolding apparatus requiring no cross bracing and having adjustable outriggers for facilitating work on a contoured surface. The disclosed scaffolding arrangement defines a plurality of horizontal levels which are spaced apart from the contoured surface. The horizontal levels are formed from horizontally disposed structural members which are supported solely from the vertical columns. No cross bracing is required between the horizontal levels of the scaffolding. Except for the vertical support columns, the horizontal levels or work areas are open. The open work areas permit easy movement of men, material and equipment. Outriggers which are adjustable in length are provided between the fixed horizontal work platforms and the contoured surface. These adjustable outriggers can be extended outward into close proximity with the contoured surface. Thus the horizontal work platform can be extended as close as desired to the contoured surface. Selected portions of the work surface can also be moved back to permit movement of equipment from one horizontal layer to the next along the contoured surface. The disclosed outriggers utilize connectors which limit movement of the outrigger about its point of connection.

13 Claims, 13 Drawing Figures

13
12
11
10
9
8
7
6
5
4
3
2
1
II
II
10
40
42
100
80

SCAFFOLDING FOR WORKING ON CONTOURED SURFACES

CROSS REFERENCE TO RELATED APPLICATIONS

This application is a continuation-in-part of copending application Ser. No. 659,991, filed Feb. 23, 1978 which has issued as U.S. Pat. No. 4,057,943.

BACKGROUND OF THE INVENTION

1. Field of the Invention

This invention relates to scaffolding and more particularly to a unique scaffolding construction which is particularly suitable for working on contoured surfaces.

2. Description of the Prior Art

Prior art scaffolding arrangements which have been commonly used for working on contoured surfaces, such as the hull of a ship, have often been constructed for each job. The most common types of scaffolding have often utilized cross bracing, which limits workers movement, and have not provided for adjustable outrigger sections. Prior art scaffolding used in shipyards has often been constructed of wood. Wooden scaffolding presents a problem when it is desired to leave the scaffolding in place in an area, such as a dry dock, which can be filled with water.

SUMMARY OF THE INVENTION

This invention relates to a scaffolding arrangement for working on contoured surfaces. The scaffolding disclosed provides relatively large, open, unobstructed horizontal work platforms. Only vertically disposed structural support scaffolding members are positioned between the horizontal work platforms. The vertically disposed structural supports are designed and placed in such a manner that they cause minimal interference with the movement of men, material and equipment. The horizontal platforms are formed from horizontal staging or scaffolding members which are supported only from the vertical scaffolding members. The ends of the horizontally disposed scaffolding members have connectors formed integral therewith which are connected to integral connectors formed on the vertical scaffolding members. The disclosed arrangement can provide for large horizontal work areas which are obstructed only by the vertical support columns. A portion of each horizontal layer is spaced apart from the contoured surface. Outriggers are supported from the horizontal structural support members and the vertical structural support members to extend in the area between the contoured surface and the horizontal layer. Wooden planks or a deck can be provided on the horizontal layer and the outrigger to provide a work area floor. Before the scaffolding is submerged, the loose wooden planks are removed. The outrigger permits the work area to be varied towards and away from the contoured surface.

It is an object of this invention to teach scaffolding apparatus which provides relatively large and open horizontal work areas, without cross bracing or tie rods which would be in the way of workmen or the storage of material, having high strength for working on the side of a contour surface.

It is a further object of this invention to teach a scaffolding arrangement for use on a contoured surface having large horizontal work areas spaced apart from the contoured surface and outriggers disposed between the horizontal work area and the contoured surface for extending a work platform into proximity to the contoured surface.

BRIEF DESCRIPTIONS OF THE DRAWINGS

For a better understanding of this invention, reference may be had to the preferred embodiment exemplary of the invention shown in the accompanying drawings in which.

DESCRIPTION OF THE PREFERRED EMBODIMENTS

Figure 1:
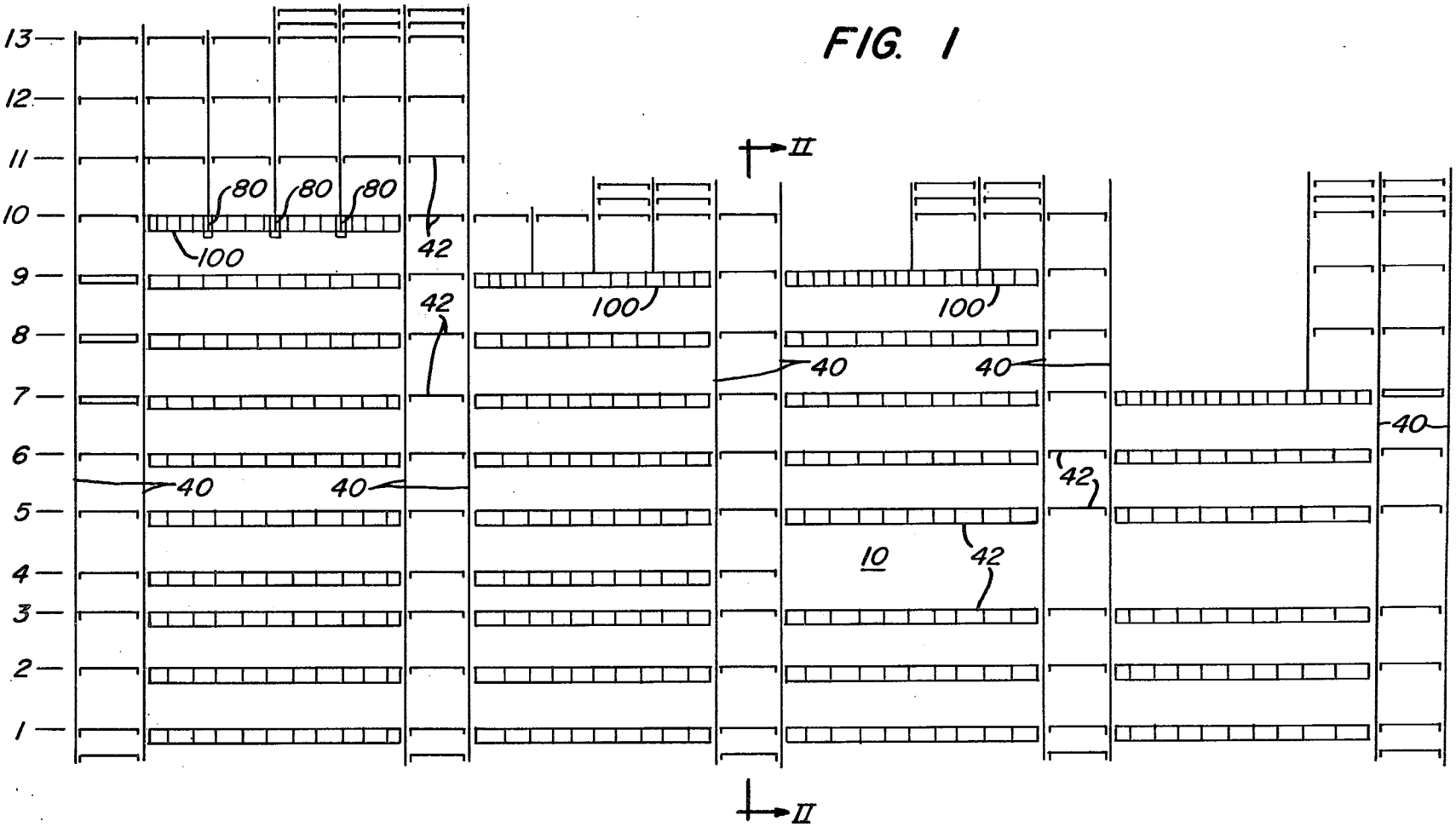
FIG. 1 is a side view of a scaffolding arrangement according to the teaching of the present invention looking towards a contoured surface on which work is being performed.
Figure 2:
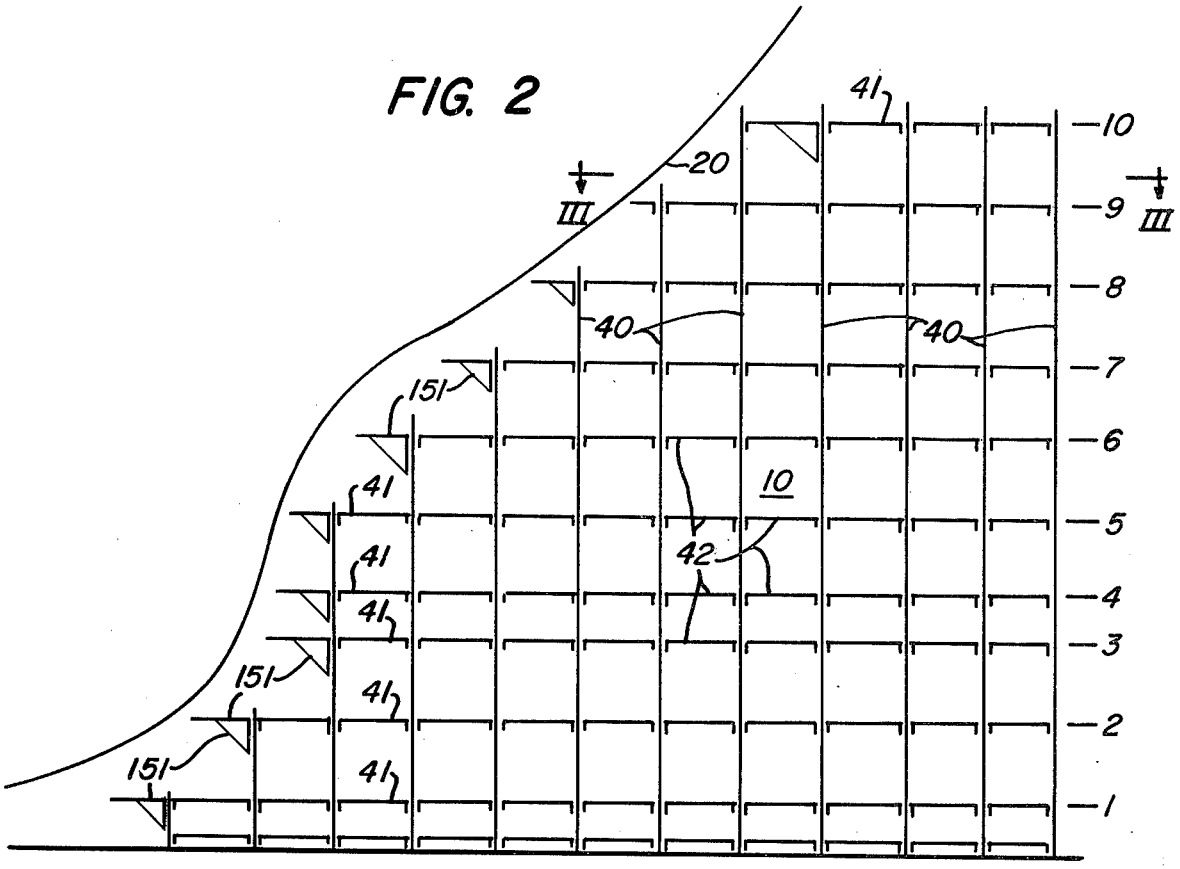
FIG. 2 is a view in FIG. 1 along the line II—II.
Figure 3:
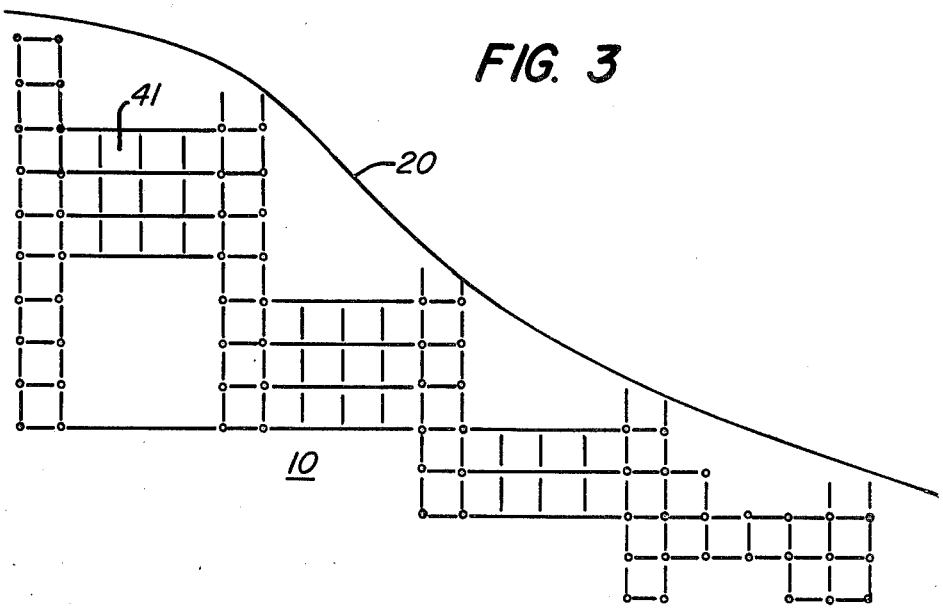
FIG. 3 is a view of the scaffolding shown in FIG. 2 along the line III—III, showing level number 9.
Figure 6:
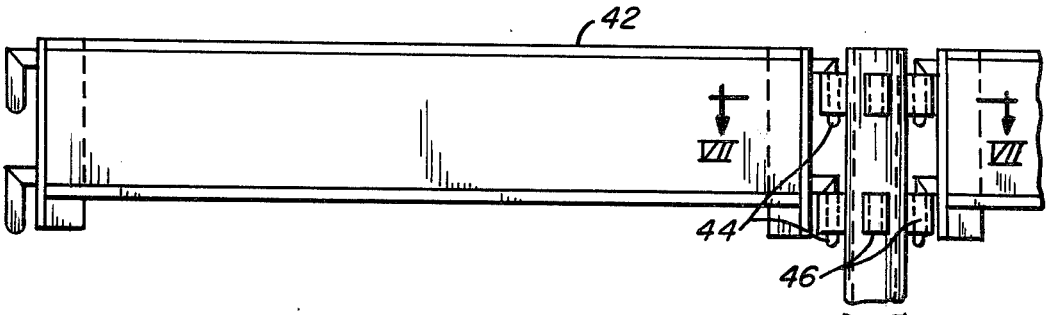
FIG. 6 is a view of a portion of the scaffolding shown in FIG. 1 showing in more detail a vertical section and a horizontal support member.
Figure 7:
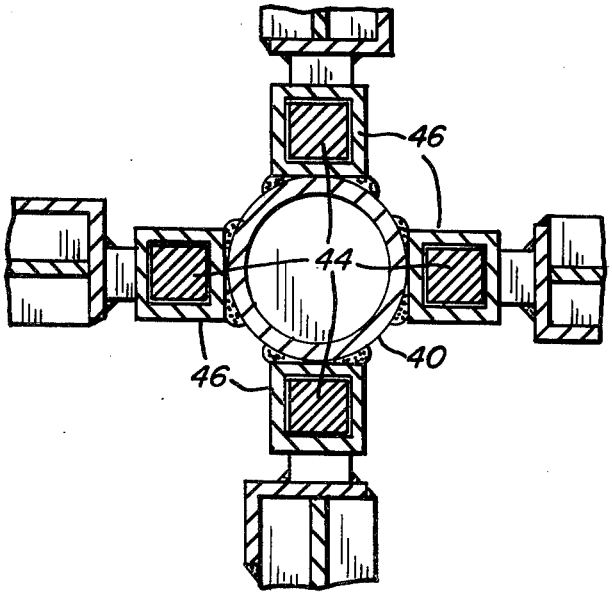
FIG. 7 is a view in FIG. 6 along the lines VII—VII.
Figure 7:
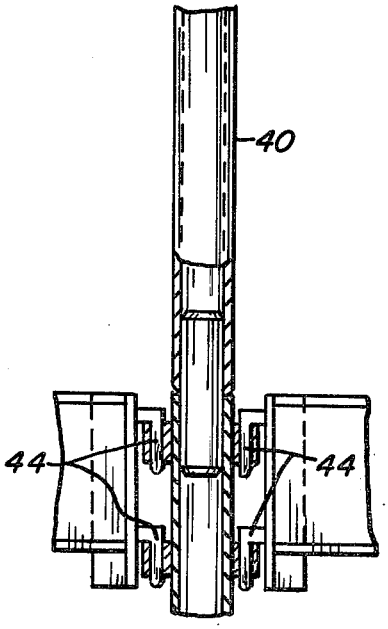
Figure 8:
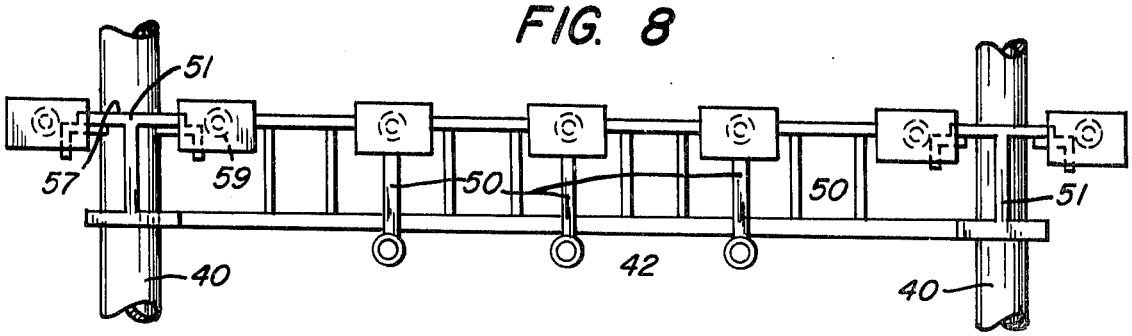
FIG. 8 is a front view of a plurality of outriggers some of which are connected to vertical columns and some of which are supported from a horizontal structural support member.

Referring now to the drawings and FIGS. 1, 2 and 3 in particular there is shown a scaffolding arrangement 10 particularly suitable for working on contoured surfaces. The scaffolding arrangement shown is utilized for working on a contoured ship hull 20. Scaffolding 10 is constructed from a plurality of vertical members 40 which provide vertical support from the ground. Horizontal members 42 are supported only from vertical members 40. There is no cross bracing between horizontal members 42 of different layers. The only support for horizontal members 42 is provided by vertical members 40. As can best be seen in FIG. 6, both ends of each horizontal member 42 are provided with studs 44 which engage or are connected to mating receptacles 46 disposed on vertical columns 40. The end of horizontal members 42 can be formed with a squared tubular member 46 in place of connector 44 and a securing pin can be disposed therethrough to connect the horizontal member 42 to members 46 on the vertical support column 40. The horizontal members 42 are disposed to divide the scaffolding into a number of spaced apart horizontal layers 41. Various other horizontal members can also be used for interconnecting horizontal members 42 on the same work level 41. A wooden work surface is provided by positioning planks 60 across selected horizontal members 42 at each level. The work platform constructed provides for free movement of men, material, and machinery. The disclosed construction provides a relatively strong platform structure which can support heavy loads at each horizontal level where planks 60 are installed. Materials and equipment utilized for working on the contoured surface 20 can be moved along the planks 60 which are provided at selected areas on each horizontal level. Supporting horizontal members 42 only from the vertical columns 40 provides a relatively open work area at each level, obstructed only by the vertical columns 40. Cross bracing which could restrict moving in the work area is eliminated. Eliminating cross bracing is an important consideration where material must be unloaded, stored and moved on the work level.

Figure 11:
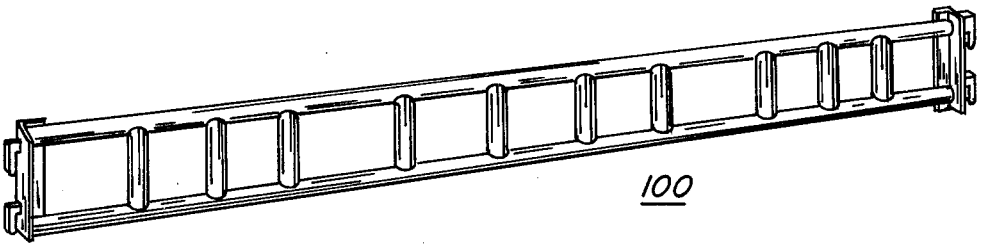
FIG. 11 is a side view of a combined ledger or truss.
Figure 12:
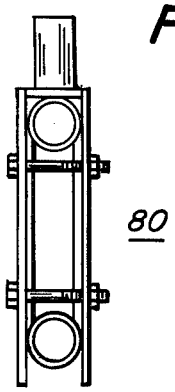
FIG. 12 is a side view of a yoke for supporting vertical columns used with the ledger of FIG. 11; and, FIG. 13 is a side view of an outrigger used for spanning greater distances than the outrigger of FIG. 10.

A relatively long combined ledger or truss 100 is utilized to connect spaced vertical sections 40. Closer spaced vertical sections can be built up from the top of the combined ledger 100 to fit the contour of the ship. A work surface can then be formed where needed. This construction eliminates many vertical sections. A typical combined ledger is shown in FIG. 11. A yoke as shown in FIG. 12 is utilized for supporting the vertical columns from the combined ledger 100. A typical length of combined ledger 100 is 28 feet.

The fixed horizontal levels defined by horizontal members 42 terminate a distance from the contoured surface on which work is to be performed. Adjustable outriggers 50 and 51 are provided along the periphery of each work level extending the work area 41 into close proximity to the contoured surface 20. That is, a portion of each work area is variable and can be adjusted to accommodate the movement of equipment as work progresses on the contoured surface.

Figure 9:
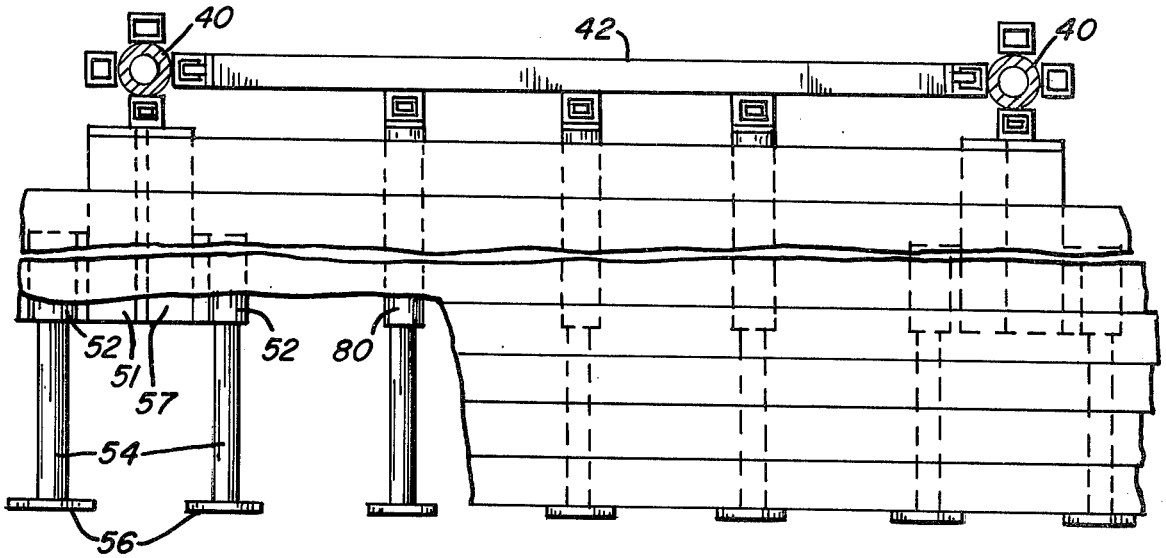
FIG. 9 is a view of the outrigger shown in FIG. 8 with portions broken away for clarity; and, FIG. 10 is a side view of another type of outrigger which is shown in FIG. 9.

FIG. 9 shows a detail of the outriggers 50, 51 with planks 60 installed. Plank 60 are provided to be supported from adjustable outrigger 50 and 51. Outrigger 51 extends out only from a fixed vertical column 40. Outriggers 50 extend outward only from a fixed horizontal member 42. The outriggers are connected only at one end by a strong connector, which prevents movement around the connection axis, such as a Swiss-Lok connection manufactured by Swiss Fabricating, Inc., Pittsburgh, Pa. During initial working the outriggers 50 and 51 are extended to be in close proximity to the contoured surface 20. Planking 60 is provided where necessary so that the separation between the contoured 20 and any work level 41 is kept relatively small to provide a safe working area.

Figure 4:
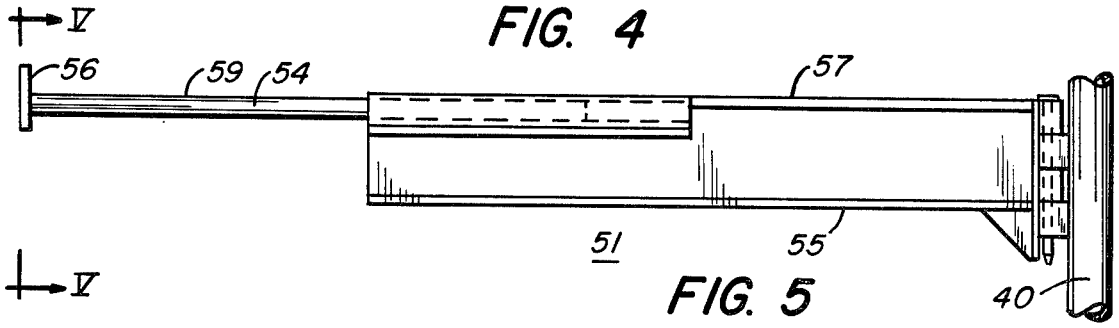
FIG. 4 is a side view of an adjustable outrigger constructed according to the teaching of the present invention.
Figure 5:
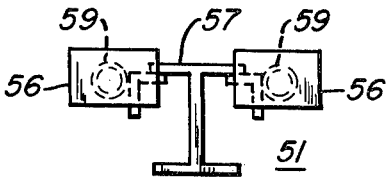
FIG. 5 is a front view of the outrigger shown in FIG. 4.

As can best be seen in FIGS. 4 and 5, the adjustable outriggers 51 are formed from an I-beam 55 which has two tubular members 52 attached thereto. Tubular members 52 each support a movable tubular member 54 which can be selectively positioned therein. The free end of movable tubular members 54 has a flange 56 formed thereon to support planks 60 when installed. Adjustable outriggers 51 are only supported from vertical columns 40 and there is no interconnection required between outriggers of different levels. Outrigger 51 has a top support face 57 defined by I-beam 55 and a movable support face 59 defined by the top of tubular member 54. Flange 56 extends above the adjustable support face 59.

Figure 10:
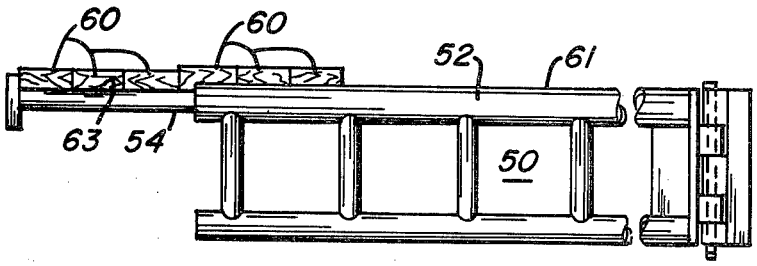

Another type of outrigger 50 is shown in detail in FIG. 10. Outriggers 50 are attached only to horizontal members 42 which extend between the outer vertical members 40. Outrigger 50 comprises a female member 52 which receives a male tubular member 54. Tubular members 52 has a top which defines the fixed outrigger support 61 and adjustable tubular member 54 has a top which defines an adjustable support 63. The disclosed outriggers 50, 51 are formed from standard material and are of a relatively inexpensive construction. The outer tubular member 52 surrounds the movable tubular member 54 for a relatively long distance so that tubular member 54 provides a strong support and permits little movement of member 54 away from the longitudinal axis of member 52. Outriggers 50 and 51 are generally of the same length. Outriggers 51 have two supports relatively close together for supporting the ends of plank 60. Thus the ends of planks 60 are disposed to be supported by outrigger 51. Planks 60 used around the periphery are thus selected to extend between a pair of outriggers 51. Outriggers 50 provide support for the planks 60 intermediate their ends which are supported by outriggers 51.

The outriggers 50 and 51 thus permit the work level 41 to be in close proximity to the side of the contoured surface 20. This permits for easy working on the contoured surface 20. Moving the outriggers 50 and 51 back permits equipment such as automatic welders to easily move down the contoured surface 20. The disclosed scaffolding arrangement does not require a multitude of fasteners for installation. The members are interconnected either by studs 44 engaging square tubes 46 or by a pin passing through square tubular members attached to the members to be joined. This provides a strong interconnection which can be rapidly made and requires a minimum number of tools. The disclosed construction, because of its rigid design, also eliminates bracing, other than vertical post 40 between work layers 41.

Figure 13:
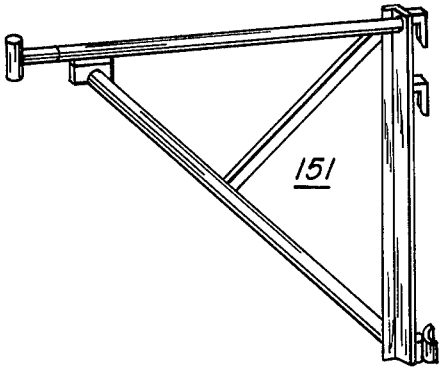

FIG. 13 shows another type of outrigger 151. This outrigger is used when a larger separation between the contoured surface and the outrigger support columns is present.

Studs 44 are square and they closely fit a squared tube 46 to form an end connector. When assembled the end connectors provide support so that horizontal members are also restrained from pivotal movement about the axis of connection to vertical post 40. This provides for easy assembly of the disclosed scaffolding 10 and assures that all interconnections are maintained generally perpendicular. Scaffolding 10 can thus not be out of alignment when assembled. Similar end connectors are provided for the outriggers 50, 51. Preventing pivitol movement about the point of connection is particularly critical for outriggers 50, 51, since these are connected to vertical posts 40 or horizontal members 42 at one end only. Also if substantial pivitol movement of outriggers 50, 51 was permitted, this would effect the stability and rigidity of the periphery of work level 41 defined by outriggers 50, 51. The disclosed scaffolding can be constructed and positioned to accommodate various size and shapes of contoured surfaces. The disclosed scaffolding is reusable on various other jobs.

I claim:

1. A modular scaffolding apparatus for working on a contoured exterior surface comprising:

a plurality of modular structural members each having integral connectors for engaging other structural members;

said plurality of modular structural members being interconnected to define a pluraltiy of horizontal levels which are spaced apart from the contoured exterior surface;

support means for supporting the structural members at each horizontal level comprising only vertically oriented support columns;

adjustable outrigger members disposed on said plurality of modular structural members and extending horizontally therefrom between the contoured exterior surface and an associated horizontal level;

each adjustable outrigger comprises an elongated horizontal fixed portion and an elongated horizontal movable portion which can be moved into close proximity to the contoured external surface; and, a wooden working surface comprising planks supported on one of said plurality of horizontal levels and the associated outriggers to provide an open horizontal level in close proximity to the contoured external surface which is only interrupted by said vertical support columns.

2. A modular scaffolding arrangement as claimed in claim 1 wherein:

each adjustable outrigger comprises a fixed tubular member, a movable tubular member partially disposed in said fixed tubular member and being relatively slidable in said fixed tubular member, and a stop plate attached to the free end of said movable tubular member.

3. A modular scaffolding apparatus as claimed in claim 2 wherein said plurality of modular structural members and said adjustable outrigger members are formed from steel.

4. A modular scaffolding apparatus as claimed in claim 3 comprising:

rigid connecting means associated with each outrigger for attaching each outrigger to one of said plurality of modular structural members for preventing movement of the outrigger relative to its point of connection; and, said rigid connection means comprises two horizontally extending studs which are fastened to said outrigger and two horizontally extending tubular members, having the same cross-section as said stud, which are secured to the modular structural member to which outrigger is connected.

5. Scaffolding for use on an exterior contoured surface comprising:

a plurality of vertical structural members interconnected to form structural support columns;

a plurality of horizontal structural members connected to the structural support columns to define horizontal layers each of which has a side spaced apart from the exterior contoured surface;

a plurality of outriggers, adjustable in length, supported from some of said horizontal structural members and some of said plurality of vertical structural members and each extending horizontally outward into the area between an associated horizontal layer and the exterior contoured surface;

said plurality of outriggers having a top support surface in substantially the same plane as the associated horizontal layer, the length of the top support is adjustable to bring the top support adjacent the exterior contoured surface;

rigid connecting means associated with each outrigger for connecting the associated outrigger to the member from which it is supported and for preventing the movement of the outrigger relative to its point of connection to the supporting member; and, flooring supported on said plurality of outriggers and the associated horizontal layer to define a work area which extends close to the exterior contoured surface.

6. Scaffolding as claimed in claim 5 wherein:

said rigid connecting means comprises two vertically extending studs which are fastened to the outrigger and two vertically extending tubular members which have the same cross-section as said studs and which are secured to the structural member which supports said outrigger.

7. Scaffolding as claimed in claim 6 wherein said outrigger comprises:

a first tubular member;

a second tubular member partially supported within said first tubular member and slidable into said first tubular member to adjust the length of said outrigger;

a first elongated support surface fixed with respect to said first tubular member;

a second elongated support surface defined by the top of said second tubular member and being aligned on the same longitudinal axis with said first elongated support surface.

8. Scaffolding as claimed in claim 7 comprising:

a plate attached to the outer end of said second tubular member and extending above said second elongated support surface.

9. Scaffolding as claimed in claim 8 wherein all members are formed of metal.

10. Scaffolding for use on a contoured surface comprising:

a plurality of vertical support columns;

a plurality of horizontal support members connected between said plurality of vertical support columns to define a plurality of spaced apart horizontal layers;

each horizontal layer having a portion which is spaced apart from said contoured surface;

a first plurality of outriggers, adjustable in length, extending outward only from a selected horizontal layer, between the layer and the contoured surface, each being supported from one of said plurality of horizontal support members;

a second plurality of outriggers, adjustable in length, extending outward only from the selected horizontal layer, between the layer and the contoured surface, each being supported from one of said plurality of vertical columns;

each of said plurality of outriggers comprises an I-shaped beam having a top flat surface, with a pair of fixed tubular members connected on each side of the top flat surface, a pair of tubular members which are movable each being positioned in and supported by one of said pair of fixed tubular members; and, deck means supported by said first plurality of outriggers and said second plurality of outriggers to provide a work area floor in close proximity to the contoured surface.

11. Scaffolding as claimed in claim 10 wherein said first plurality of adjustable outriggers comprises:

a first tubular member; and, a second tubular member disposed for sliding movement within first tubular member and supported by said first tubular member.

12. Scaffolding as claimed in claim 11 wherein:

said first and said second plurality of outriggers are connected by connecting means which limit movement at the point of connection.

13. Scaffolding as claimed in claim 12 comprising:

a plate attached to the upward extending end of said set of tubular members.

* * * * *